United States Patent [19]

Asakawa et al.

[11] Patent Number: 5,072,840

[45] Date of Patent: Dec. 17, 1991

[54] MEDICAL BED APPARATUS

[76] Inventors: Yoshio Asakawa, No. 287, Tsufuku-Honmachi, Kurume-shi, Fukuoka-ken, Japan; Yasunaga Suezaki, No. 501-3, Oaza-Kitoin, Yame-shi, Fukuoka-ken, Japan

[21] Appl. No.: 551,593

[22] Filed: Jul. 10, 1990

[30] Foreign Application Priority Data

Dec. 28, 1989 [JP] Japan ..... 1-343165

[51] Int. Cl.[5] ..... B66C 17/00; B66C 19/00; B66D 1/30; A61G 7/08

[52] U.S. Cl. ..... 212/205; 414/921; 5/81 B; 254/374; 212/209

[58] Field of Search ..... 414/921; 5/87; 4/561, 4/560, 562, 563, 564; 254/374, 278, 294; 212/209, 205, 134, 135

[56] References Cited

U.S. PATENT DOCUMENTS 2,420,072 5/1947 Foote ..... 254/374

4,639,955 2/1987 Carminati et al. ..... 414/921

*Primary Examiner*—Joseph F. Peters, Jr.

*Assistant Examiner*—Kenneth Lee

*Attorney, Agent, or Firm*—Townsend and Townsend

[57] ABSTRACT

A medical bed apparatus is provided that has a body frame, a hoisting assembly and a hammock supported from the hoisting assembly by hanging strings. The body frame is positioned over a hospital bed or the like and a person is placed on the hammock. A pair of drums are provided in the hoisting assembly so that the hanging strings may be hoisted or wound on the drums in a first direction to lift the hammock. The drums are preferably cone-shaped such that the head portion of the hammock is initially lifted at a rate that is faster than the rate the foot portion of the hammock is lifted. Once the person's upper torso is substantially upright, the lifting rate for the head and foot portion of the hammock are substantially equal. Once the person is lifted, the hoisting assembly is horizontally movable in both the x and y directions so that the person may be maneuvered away from the bed and positioned in an upright sitting position over a urinal, bath or chair. The lifting and maneuvering procedure may be reversed so that the person is repositioned over the bed and returned to a substantially horizontal position by reversing the hoist direction of the drums. The hanging strings are maintained in a substantially vertical orientation by moving the drum hoisting the head portion and the drum hoisting the foot portion of the hammock toward each other as the person is lifted and moving the drums away from each other as the person is lowered.

4 Claims, 8 Drawing Sheets

MEDICAL BED APPARATUS

BACKGROUND OF THE INVENTION

1. Field of the Invention

This invention relates to a medical bed apparatus and, more particularly, to an apparatus for moving a person laid on a bed to other place such as a bath, a lavatory, a wheeled chair, etc.

2. Description of the Prior Art

There is known a medical bed apparatus used in a hospital or an old-age home for hanging a patient who cannot move by himself by a hammock and moving him to a bath or a lavatory near a bed.

However, when a patient is carried in a hammock and hung from a bed or laid down on the bed, the neck, waist, knees, etc of his body are loaded to feasibly suffer from a pain.

SUMMARY OF THE INVENTION

Accordingly, an object of this invention is to provide a medical bed apparatus in which a patient can be hung or laid down without pain.

In order to achieve this and other objects, there is provided according to this invention a medical bed apparatus having a body frame, a hoisting means provided horizontally movably at the top of the body frame, and a hammock hoisted from the hoisting means comprising:

a first hanging string attached to the end of said hammock for hanging the head side of a person laid on the hammock by said hoisting means;

a second hanging string attached to the rear end of the hammock for hanging the leg side of the person;

a drum for hoisting the hanging strings; and a motor for rotating the drum, whereby the hoisting speed of said first hanging string is faster than that of said second hanging string.

With the arrangement of the medical bed apparatus described above, the person laid on the bed can be hung from the bed without applying a pain to the person body, and moved to an object place such as a bath or an urinal, and can also be laid back on the bed.

These and other objects and features of the present invention will become apparent from the following detailed description in conjunction with the attached drawings.

DESCRIPTION OF THE PREFERRED EMBODIMENT

An embodiment of a medical bed apparatus according to the present invention will now be described with reference to the accompanying drawings.

Figure 1:
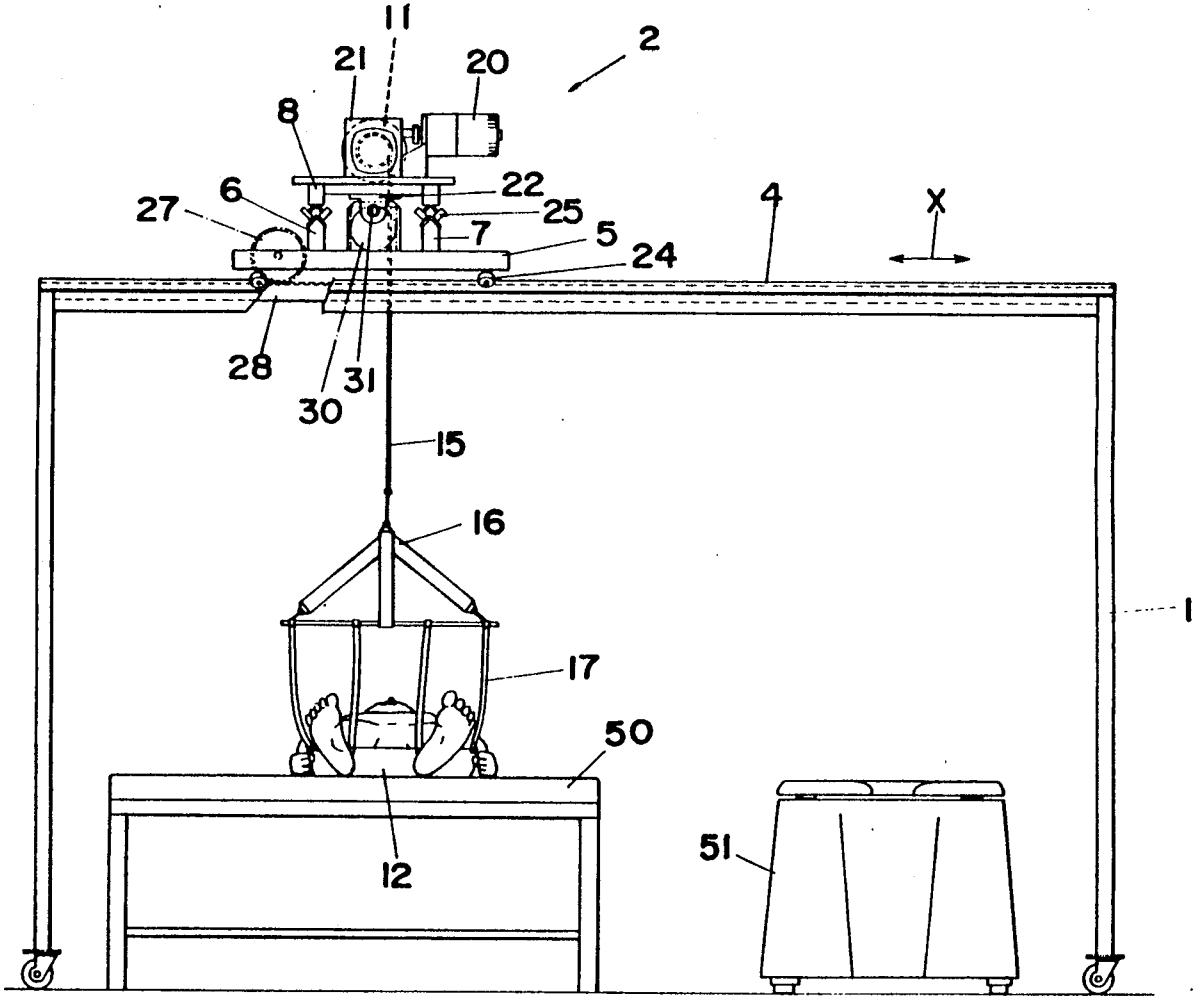
FIG. 1 is a front view of an embodiment of a tiltable bed apparatus according to the present invention.
Figure 2:
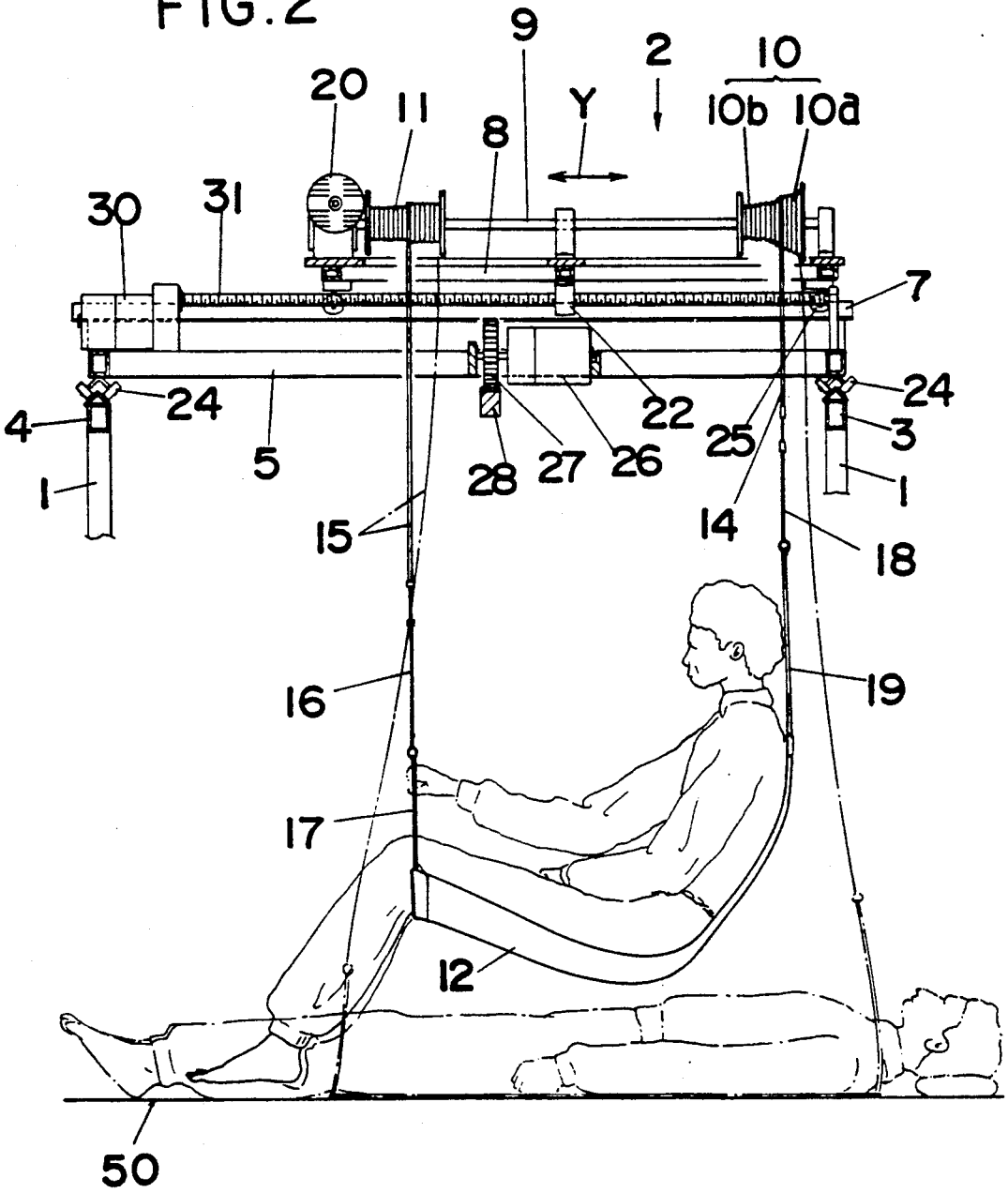
FIG. 2 is a side view of the bed apparatus.
Figure 3:
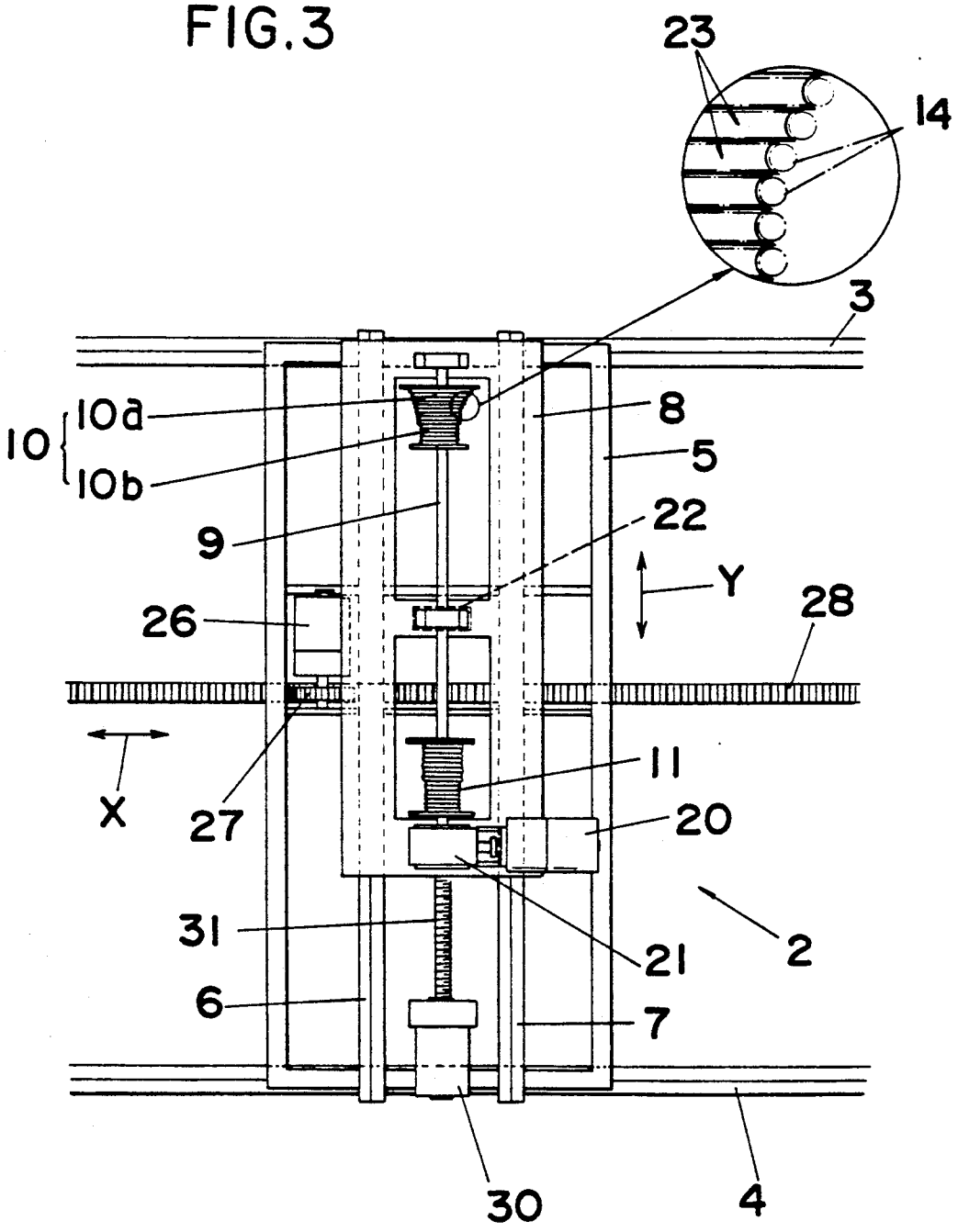
FIG. 3 is a plan view of the bed apparatus.

FIG. 1 is a front view of an embodiment of a medical bed apparatus according to the present invention, FIG. 2 is a side view of the apparatus, and FIG. 3 is a plan view of the apparatus. Reference numeral 1 denotes a body frame. A bed 50 and an urinal 51 are positioned under the body frame 1. This medical bed apparatus is provided for transferring a patient laid on the bed 50 to another place such as the urinal 51 or a bath (not shown).

In FIGS. 2 and 3, a hoisting unit 2 is provided at the top of the body frame 1. The hoisting unit 2 is adapted to vertically move a hammock 12 up or down. The hoisting unit 2 is further adapted so that the hammock 12 may be moved in the horizontal direction. Reference numerals 3 and 4 denote X rails. Reference numeral 5 denotes an X frame placed on the X rails 3 and 4 through rollers 24. Numeral 28 denotes a rack provided in parallel with the X rails 3 and 4. A motor 26 for rotating a pinion 27 is mounted in the X frame 5. The pinion 27 is engaged with the rack 28. When the motor 26 is driven, the X frame 5 moves along the X rails 3 and 4 in an X direction.

In FIG. 1, Y rails 6 and 7 are provided in the upper portion of the X frame 5. Numeral 8 denotes a Y frame which is placed on the Y rails 6 and 7 through rollers 25. In FIG. 2, numeral 30 denotes a motor mounted on the X frame 5. Numeral 31 denotes a feed screw driven by the motor 30. The feed screw 31 is engaged with a nut 22 provided in the Y frame 8. When the motor 30 is driven, the Y frame 8 slides along the Y rails 6 and 7 in a Y direction.

In FIG. 3, numeral 9 denotes a rotational shaft provided in the Y direction on the Y frame 8 and rotated by the motor 20. Numeral 21 denotes a reduction gear. Drums 10 and 11 are mounted at both ends of the rotational shaft 9. As shown in FIG. 2 first and second hanging strings 14 and 15 are respectively wound on the drums 10 and 11. The first hanging string 14 is coupled to one end of the hammock 12 through hangers 18 and 19 to lift the head side of the person placed on the hammock 12. The second hanging string 15 is coupled to the other end of the hammock 12 through hangers 16 and 17 to lift the leg side of the person placed on the hammock 12.

The drum 10 has a large-diameter portion **10*a* and a small-diameter portion 10*b*. As shown in the partially enlarged view of FIG. 3, guide grooves 23 for the hanging string 14 are spirally formed on the drum 10. The drum 10 rapidly hoists the hanging string 14 at the large-diameter portion 10*a* and slowly hoists the hanging string 14 at the small-diameter portion 10*b*. The diameter of the drum 11 is the same as that of the small-diameter portion 10*b* of the drum 10. Accordingly, in FIG. 2, when the motor 20 is driven, a person laid on the bed 50 is lifted, the hanging strings 14 and 15 are hoisted or wound on drums 10 and 11. In this case, the hanging string 15 is slowly hoisted at a constant speed by the drum 11 but the hanging string 14 is first rapidly hoisted by the large-diameter portion 10*a* faster than the hanging string 15. Thus, the upper half body of the person laid on the hammock 12 is raised (as designated by solid lines in FIG. 2). Then, since the hanging string 14 is hoisted from the small-diameter portion 10*b***, the head side and the leg side of the person are slowly raised at the same speed in the state that the upper half body of the person is raised. According to the apparatus constructed as described above, the person can be raised while raising the upper half body of the person.

If the person is hung in this manner, the motors 26 and 30 are driven to move the Y frame 8 in the XY direction thereby to move the hammock 12 in the XY direction, thereby moving the person to a target place such as the urinal 51 and the like.

When the motor 20 is reversibly rotated, the hanging strings 14 and 15 of the drums 10 and 11 are hoisted back thereby to move down the hammock 12. In this case, the hanging string 15 is slowly hoisted back at a constant speed by the drum 11, but since the hanging string 14 is first slowly hoisted back at the same speed as that of the hanging string 15 by the small-diameter portion 10*b*, the person is moved down while the upper half body of the person remains raised. When the person is moved down to the vicinity of the bed 50, the hanging string 14 is hoisted back rapidly by the large-diameter portion 10*a*. Thus, the upper half body of the person is tilted down on the bed, and the person is laid on the bed 50 substantially in a horizontal state. According to this apparatus constructed and operated as described above, the person is hung from the bed 50 or laid on the bed 50 while his half body is being raised, thereby moderating the pain to be applied to the person and transferring the person in the XY direction in his pleasant attitude.

Second Embodiment

Figure 4:
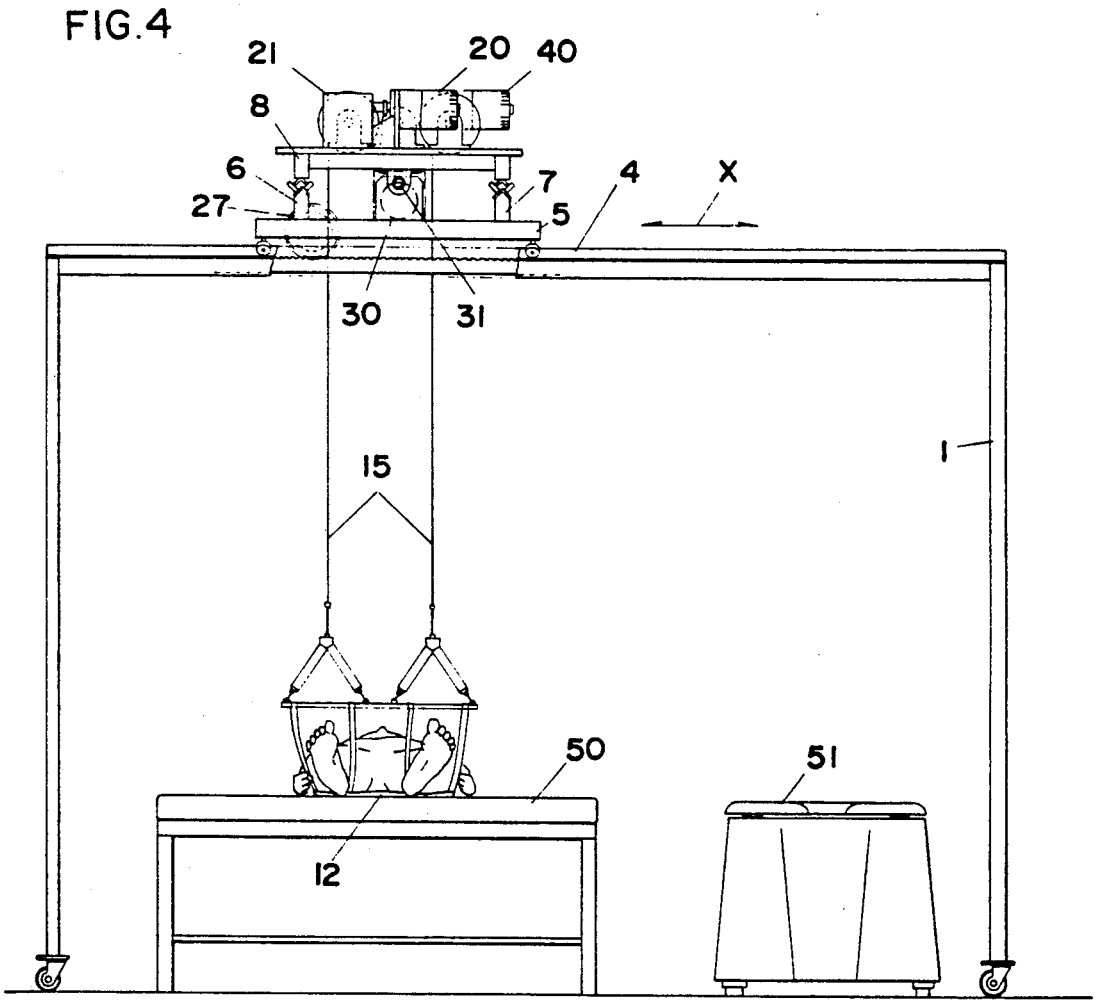
FIG. 4 is a front view of another embodiment of a bed apparatus according to the present invention.
Figure 5:
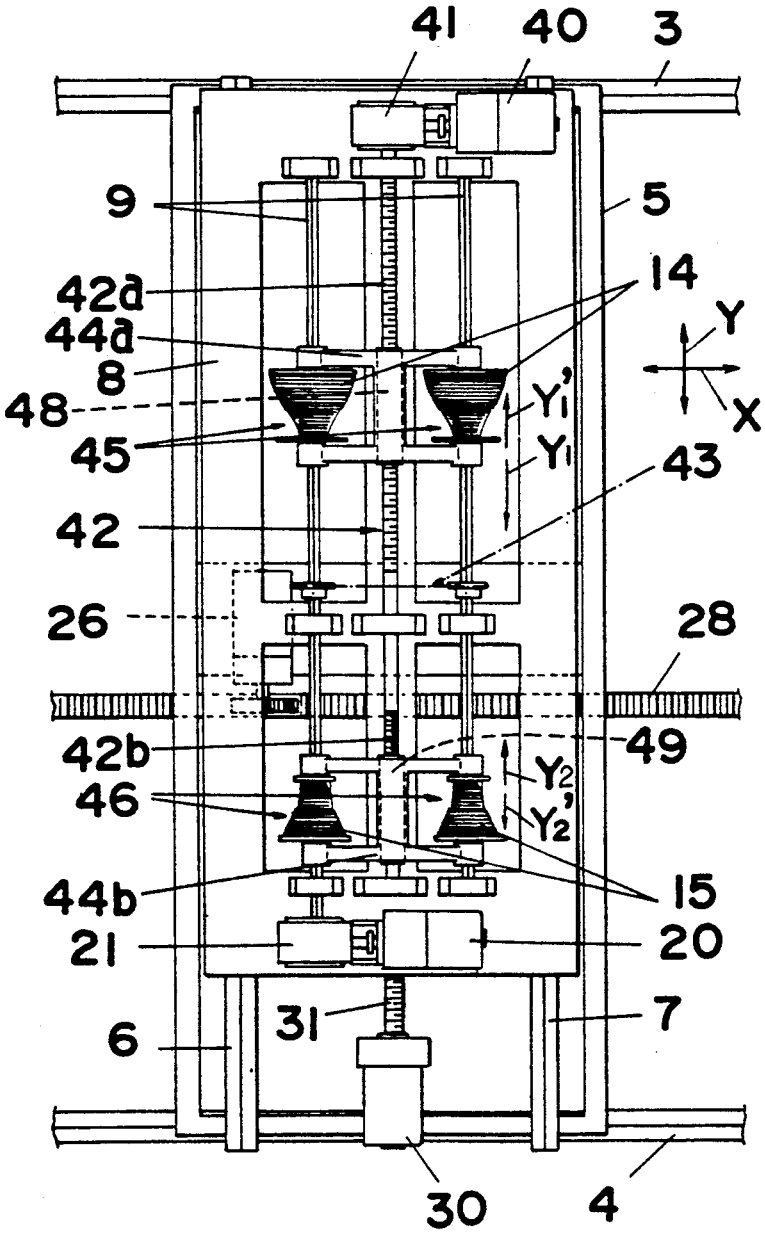
FIG. 5 is a plan view of the bed apparatus.
Figure 6:
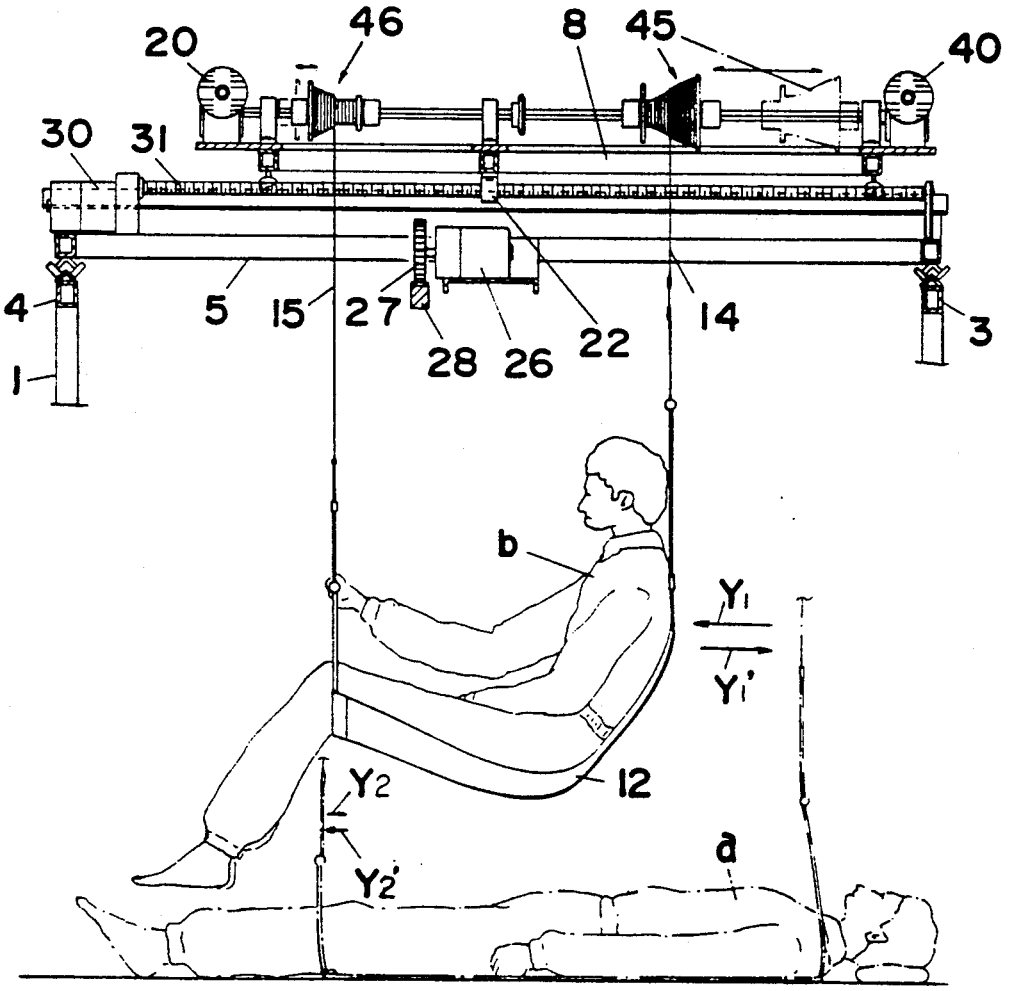
FIG. 6 is a side view of the bed apparatus.

FIGS. 4 to 6 show another embodiment of a medical bed apparatus according to the present invention. In the second embodiment, two hanging strings 14, 14 and 15, 15 are respectively attached to the hammock 12. Thus, a hammock 12 is supported at each end of the hammock 12 by the two hanging strings 14, 14 and 15, 15 to prevent the hammock 12 from laterally fluctuating rightward and leftward in FIG. 4.

In FIG. 5, two rotational shafts 9 and 9 are provided in Y frame 8. Two large-diameter drums 45, 45 and two small-diameter drums 46, 46 are respectively mounted at the rotational shafts 9, 9. Symbols 44*a* and 44*b* denote frames in which the drums 45 and 46 are mounted. The rotational shafts 9 and 9 are coupled to each other by a chain 43. Accordingly, when the motor 20 is driven, four drums 45, 45 and 46, 46 respectively hoist up or back the hanging strings 14, 14 and 15, 15.

Numeral 42 denotes a feed screw provided in a Y direction between the rotational shafts 9 and 9, numeral 40 a motor for driving the feed screw 42, and numeral 41 a reduction gear. On the feed screw 42 are formed threads 42*a* having a large pitch and threads 42*b* having a small pitch in a reversibly threaded direction, and nuts 48 and 49 provided integrally at the frames 44*a* and 44*b* are respectively engaged with the threads 42*a* and 42*b* of the feed screw 42. When the motor 40 is driven to rotate the feed screw 42, the frames 44*a* and 44*b* are moved reversibly to each other in Y1 and Y2 directions.

In FIG. 6, when the motor 20 is driven to hoist the hanging strings 14, 14 and 15, 15, a person is raised from a position "a" to a position "b". In this case, since the drum 45 has a larger diameter than the drum 46, the upper half body of the person is rapidly raised faster than the leg side of the person so that the upper half body is raised. In this case, the motor 40 is rotated, the drum 45 is moved along the threads 42*a* in a direction of an arrow Y1, and the drum 46 is moved along the threads 42*b* in a direction of an arrow Y2. When the motors 20 and 40 are rotated reversibly, the hammock 12 is moved down while the drums 45 and 46 are being moved in directions Y1' and Y2'. In this manner the person is moved down from the position "b" to the "position a". Thus, when the drums 45, 45 and 46, 46 are moved in the Y direction upon vertical movements of the hammock 12 the person can be raised or lowered pleasantly without applying a load to the body while the upper half body of the person is being raised.

Third Embodiment

Figure 7:
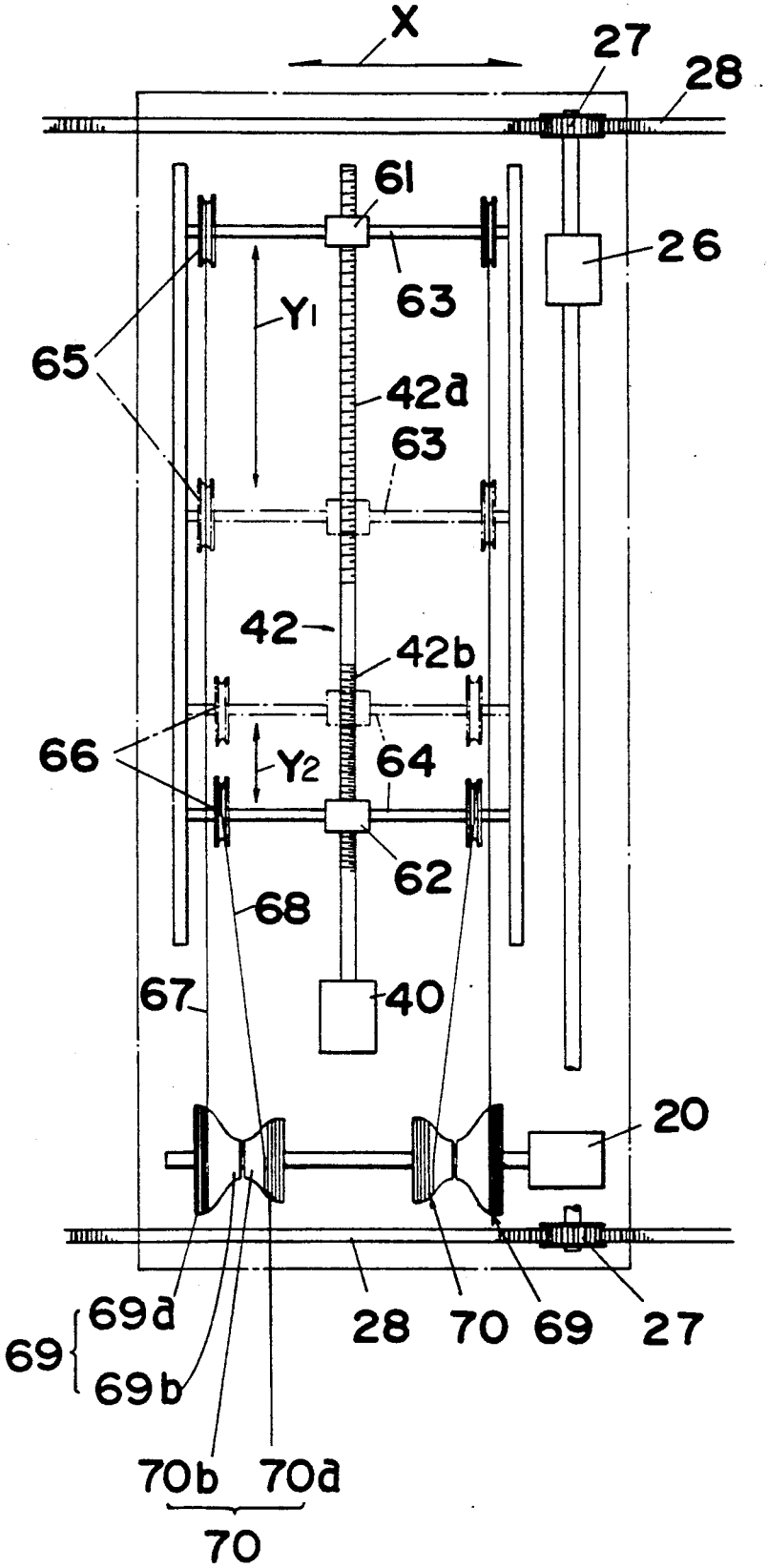
FIGS. 7 and 8 are plan and side views of still another embodiment of a bed apparatus according to the invention.
Figure 8:
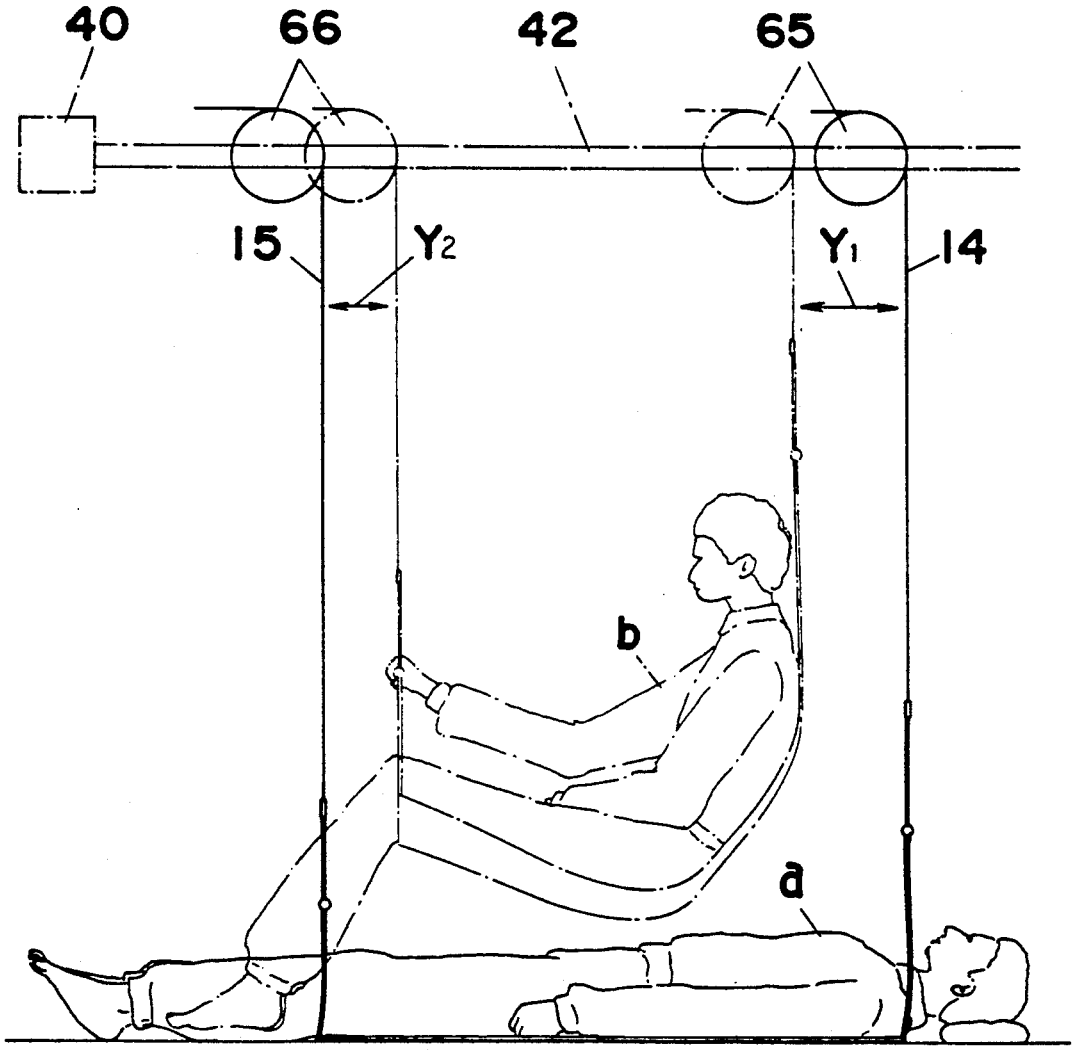

In FIGS. 7 and 8, right and left pinions 27 and racks 28 are provided, and an X frame 5 is moved along the rack 28 in an X direction. Nuts 61, 62 are respectively mounted at the threads 42*a* and 42*b* of a feed screw 42. Numerals 63 and 64 denote shafts attached to the nuts 61 and 62, and pulleys 65 and 66 are respectively attached to both ends of the shaft 63 and 64. Numerals 67 and 68 denote wires engaged on the pulleys 65 and 66, which are respectively engaged on large-sized drum 69 and small-sized drum 70. First and second hanging strings 14 and 14 are respectively coupled to the wires 67 and 68. Numeral 20 denotes a motor for driving the drums 69 and 70. Accordingly, when the motor 20 is driven, the hanging string 14 is rapidly hoisted by the large-diameter portion 69*a* of the drum 69, and slowly hoisted by the small-diameter portion 69*b* on the way. The hanging string 15 is slightly rapidly hoisted by the large-diameter portion 70*a* of the drum 70, and then slowly hoisted by the small-diameter portion 70*b* on the way. When the motor 40 is driven in this manner, the pulleys 65 and 66 are respectively moved reversibly in directions Y1 and Y2.

As apparent from the respective embodiments of the present invention described above, means for rapidly hoisting the hanging string 14 faster than the hanging string 15 may be variously provided within the scope of the present invention. For example, the rotating speed of the motor for hoisting the hanging strings 14 and 15 is controlled thereby to hoist up or back the hanging string 14 faster than the hanging string 15.

According to the present invention as described above, the upper half body of the person carried in the hammock can be raised or lowered faster than the leg side of the person. Therefore, the person can be raised pleasantly from the bed or lowered pleasantly on the bed without applying a load to the body while the upper half body is raised.

What is claimed is:

1. A medical bed apparatus having a body frame, a hoisting means provided at the top of said body frame and a hammock hoistable by said hoisting means, said medical bed apparatus comprising:

a first hanging string coupling said hoisting means with a first end of said hammock;

a second hanging string coupling said hoisting means with a second end of said hammock;

a feed screw;

a nut slidable along said feed screw;

said hoisting means having a drum means for hoisting said hanging strips whereby the hoisting speed of said first hanging string is faster than that of said second hanging string; said drum means being attached to said nut;

a first motor means for rotating said drum means so that said hammock is hoisted or lowered;

a second motor means for driving said feed screw thereby moving said drum means along said feed screw in cooperation with the hoisting up or down said first hanging string.

2. The medical bed apparatus of claim 1 wherein said drum means comprises a cone-shaped hoisting member having a large diameter portion adapted to rapidly hoist said first hanging string and a small diameter portion adapted to slowly hoist said first hanging string.

3. The medical bed apparatus of claim 2 wherein said drum means further comprises a second hoisting member having substantially constant diameter.

4. The medical bed apparatus of claim 2 wherein said drum means further comprises a second cone-shaped hoisting member having a large diameter portion adapted to rapidly hoist said second hanging string and a small diameter portion adapted to slowly hoist said second hanging string, said large diameter portions of said hoisting member being smaller than said large diameter portions of said first hoisting member.

* * * * *